US011633655B1

(12) United States Patent
Fan

(10) Patent No.: US 11,633,655 B1
(45) Date of Patent: Apr. 25, 2023

(54) SWING AID

(71) Applicant: Eagle Fan, Hsinchu (TW)

(72) Inventor: Eagle Fan, Hsinchu (TW)

( * ) Notice: Subject to any disclaimer, the term of this patent is extended or adjusted under 35 U.S.C. 154(b) by 0 days.

(21) Appl. No.: 17/694,915

(22) Filed: Mar. 15, 2022

(51) Int. Cl.
*A63B 69/36* (2006.01)

(52) U.S. Cl.
CPC ..... *A63B 69/3632* (2013.01); *A63B 69/3685* (2013.01); *A63B 2225/09* (2013.01)

(58) Field of Classification Search
CPC ..... A63B 69/3621; A63B 2071/0694
USPC ..... 473/218, 219, 257, 266, 270–273, 278, 473/279
See application file for complete search history.

(56) References Cited

U.S. PATENT DOCUMENTS 1,623,897 A * 4/1927 Williams ..... B43L 7/00 33/809
4,871,175 A * 10/1989 Levin ..... A63B 69/3667 473/218
5,893,805 A * 4/1999 Douglass ..... A63B 69/3667 473/270
5,951,409 A * 9/1999 Galley ..... A63B 69/3667 473/218
6,106,408 A * 8/2000 Roman ..... A63B 69/3667 473/270
6,604,294 B1 * 8/2003 Farley ..... G01B 3/56 33/500
6,723,003 B1 * 4/2004 Harrell ..... A63B 69/3667 473/270
2006/0283032 A1 * 12/2006 Yang ..... B43L 13/028 33/419
2014/0080619 A1 * 3/2014 Heddleston ..... A63B 69/3667 473/409

* cited by examiner

*Primary Examiner* — Nini F Legesse
(74) *Attorney, Agent, or Firm* — Lin & Associates Intellectual Property, Inc.

(57) ABSTRACT

A swing aid is provided, comprising: a support member, having an elongated shape with a first end and a second end; a first assembly, comprising a first shell and a second shell, the first shell and the second shell being pivotally connected to the first end, the first shell and the second shell being rotatable around the first end to adjust included angles with respect to the support member, respectively; a second assembly, comprising a first indicator and a second indicator, and the first indicator and the second indicator being pivotally connected to the second end, the first indicator and the second indicator being rotatable around the second end to adjust the included angles with respect to the support member, respectively.

9 Claims, 6 Drawing Sheets

SWING AID

BACKGROUND OF THE INVENTION

1. Field of the Invention

The present invention relates generally to a swing aid, and more particularly, to provide a swing training aid that provides golfers with reference to the required position, ball position, etc. before swing training.

2. The Prior Arts

The "stance" and "stance width" of a golfer are directly related to the force applied to the swing and the flight direction of the golf ball after hitting the ball. In terms of stance width, if the feet are too far apart, the rotation of the shoulders and waist will be restricted, making it difficult to exert strength; if the width is too narrow, the body will easily lose balance during rotation. The correct stance width will be dependent on the height, body shape and club length. A basic principle is: the longer the club, the wider the feet. On the other hand, the shorter the club, the smaller the width between the feet. "Ball position" refers to the position where the golf ball is placed when the player is in the ready position for hitting the ball. The ideal ball position is the lowest point in the arc created by the swing. For example, the ball position for 1-wood should be directly opposite to the inside of the left foot; for a mid-iron (5.6.7), the ball position should be slightly left to the center between the two feet; with a short iron with a larger slope, the ball will be placed at the center between the two feet. However, the traditional practice method is generally to choose the position by the feel, for example, the width of the stance is about the same as the shoulder width, or the ball position is about the middle of the left foot . . . etc. As a result, often after swinging for many times, the stance and the ball position gradually change without being noticed, and the objective of maintaining the correct swing posture through practice is lost.

SUMMARY OF THE INVENTION

A primary objective of the present invention is to provide a swing aid, adjustable to change shape, and to be placed on the ground so that the practitioner can confirm the stance position, the ball position and adjust the stance width for practice with woods, irons or putters.

In order to achieve the aforementioned objective, the present invention provides a swing aid, comprising: a support member, having an elongated shape with a first end and a second end; a first assembly, comprising a first shell and a second shell, the first shell and the second shell being pivotally connected to the first end, the first shell and the second shell being rotatable around the first end to adjust included angles with respect to the support member, respectively; a second assembly, comprising a first indicator and a second indicator, and the first indicator and the second indicator being pivotally connected to the second end, the first indicator and the second indicator being rotatable around the second end to adjust the included angles with respect to the support member, respectively.

In a preferred embodiment, surfaces of the first shell, the second shell, the first indicator and the second indicator are provided with a plurality of distance gauge symbols at equidistant intervals.

In a preferred embodiment, the support member, the first indicator and the second indicator are all plate-shaped, and the first indicator and the second indicator are pivotally connected to upper and lower opposite sides of the supper member respectively, and can be folded to become a stacked shape; the support member is located between the first indicator and the second indicator.

In a preferred embodiment, the second assembly also comprises a first extension member, the first extension member is pivotally connected to the one end away from the pivotal connection between the first indicator and the support member, the first extension member is in a shape of a plate, the first extension member, the first indicator, and the support member are in a stacked shape after being folded, and the first indicator is located in the middle layer.

In a preferred embodiment, surface of the first extension member is equidistantly disposed to form a plurality of distance gauge symbols.

In a preferred embodiment, the second assembly also comprises a second extension member, the second extension member is pivotally connected to the one end away from the pivotal connection between the second indicator and the support member, the second extension member is in a shape of a plate, the second extension member, the second indicator, and the support member are in a stacked shape after being folded, and the second indicator is located in the middle layer.

In a preferred embodiment, the surface of the second extension member is equidistantly disposed to form a plurality of distance gauge symbols.

In a preferred embodiment, the second assembly also comprises a third indicator, the third indicator is plate-shaped and pivoted to the second end, and the third indicator can be adjusted to adjust the included angle with the support member.

In a preferred embodiment, the surface of the third indicator is equidistantly disposed to form a plurality of distance gauge symbols.

In a preferred embodiment, the first shell and the second shell are half shells with matching shapes, the first shell has a first space, and the second shell has a second space; after the first shell and the second shell are combined, the first indicator, the support member and the second indicator are accommodated in the first space and the second space.

In summary, the swing aid of the present invention has the first assembly and the second assembly respectively pivoted on the two ends of the support member, and the first shell, the second shell, the first indicator, and the second indicator are adjustable to change the included angles formed between the support member and the first shell, the second shell, the first indicator, and the second indicator respectively so as to form various shapes, such as a straight line, a cross, an arrow, etc., so that the golf swing practitioner can stand in to obtain a reference position, and then adjust the stance, stance width, ball position, to improve the accuracy of each swing, leading to improved swing technique and stability.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

The technical solution of the present invention will be clearly and completely described below in conjunction with the specific embodiments and the accompanying drawings. It should be noted that when an element is referred to as being "mounted or fixed to" another element, it means that it can be directly on the other element or an intervening element may also be present. When an element is referred to as being "connected" to another element, it means that it can be directly connected to the other element or intervening elements may also be present. In the illustrated embodiment, the directions indicated up, down, left, right, front and back, etc. are relative, and are used to explain that the structures and movements of the various components in this case are relative. These representations are appropriate when the components are in the positions shown in the figures. However, if the description of the positions of elements changes, it is believed that these representations will change accordingly.

Unless otherwise defined, all technical and scientific terms used herein have the same meaning as commonly understood by one of ordinary skill in the art of the present invention. The terminology used herein is for the purpose of describing particular embodiments only and is not intended to limit the present invention. As used herein, the term "and/or" includes any and all combinations of one or more of the associated listed items.

Figure 1:
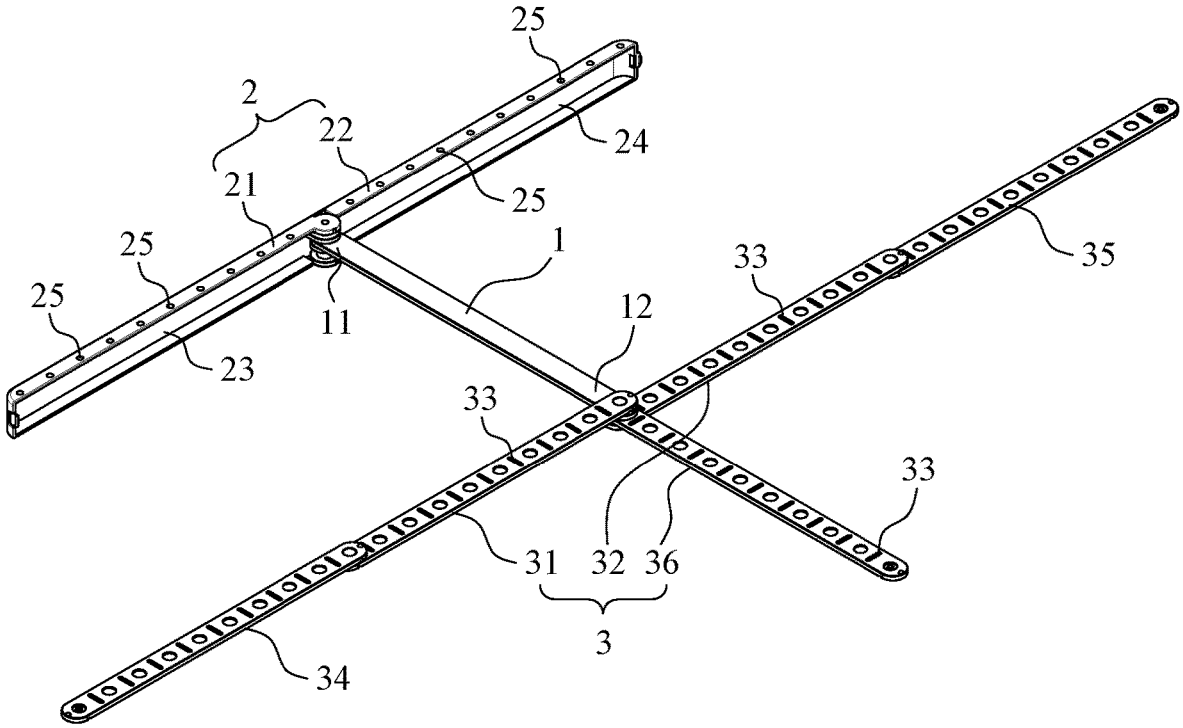
FIG. 1 is a perspective view of a swing aid for the present invention.
Figure 2:
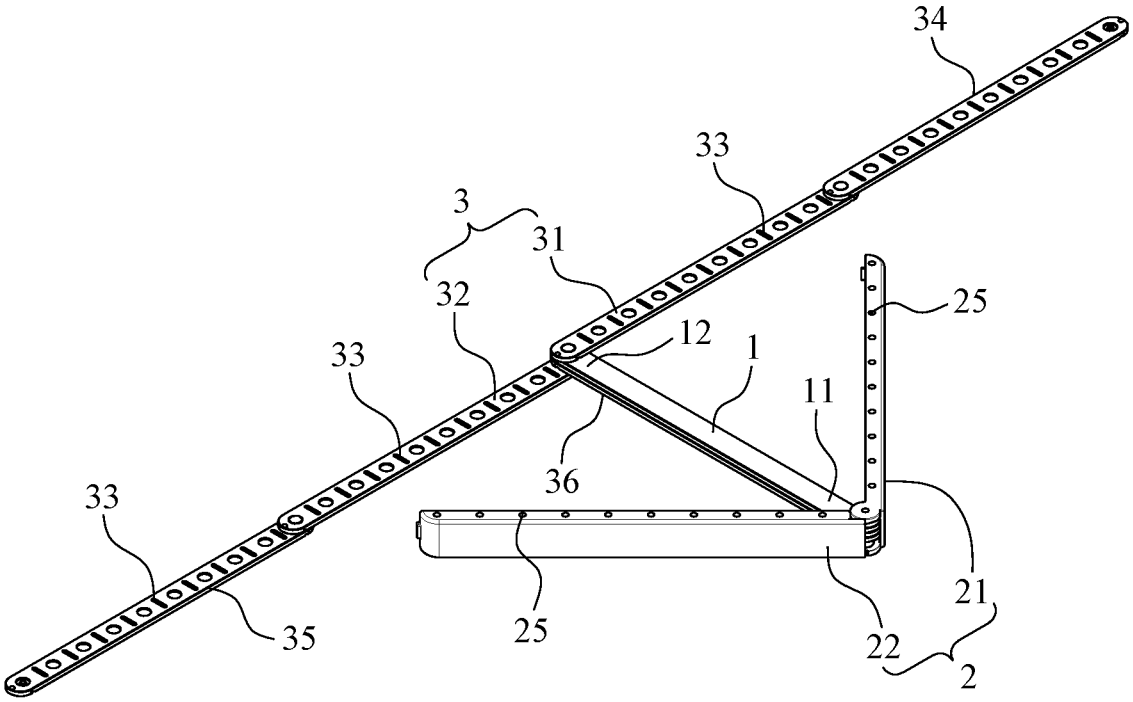
FIG. 2 is a perspective view of another form of swing aid for the present invention.

FIG. 1 and FIG. 2 are perspective views of different types of the swing aid of the present invention respectively. The swing aid of the present invention includes: a support member 1, a first assembly 2 and a second assembly 3. The support member 1 is elongated, and has a first end 11 and a second end 12. The first assembly 2 includes a first shell 21 and a second shell 22. The first shell 21 and the second shell 22 are both pivotally connected to the first end 11. The first shell 21 and the second shell 22 are rotatable around the first end 11 to adjust the included angle between the first shell 21 and the support member 1 and the included angle between the second shell 22 and the support member 1, respectively. The second assembly 3 includes a first indicator 31 and a second indicator 32. The first indicator 31 and the second indicator 32 are both pivotally connected to the second end 12. The first indicator 31 and the second indicator 32 are rotatable around the second end 12 to adjust the included angle between the first indicator 31 and the support member 1 and the included angle between the second indicator 32 and the support member 1, respectively. FIG. 1 and FIG. 2 show that the first assembly 2 and the second assembly 3 have different shapes after adjustment, and then the present invention is placed on the ground, so that practitioners can refer to the stance position, ball position and stance width for swing practice.

The following is a detailed description on the structure of each component of the present invention:

The support member 1 is a long plate with two ends, the first end 11 and the second end 12, respectively. The first end 11 is used for the first assembly 2 to be pivoted herein, so as to facilitate the first shell 21 and the second shell 22 to respectively adjust the included angle formed with the support member 1. The second end 12 is for the second assembly 3 to be pivoted herein, so as to facilitate the first indicator 31 and the second indicator 32 to respectively adjust the included angle formed with the support member 1. As such, the swing aid of the present invention can be formed into a variety of different shapes for individual putting, wood or iron swing practice.

Figure 3:
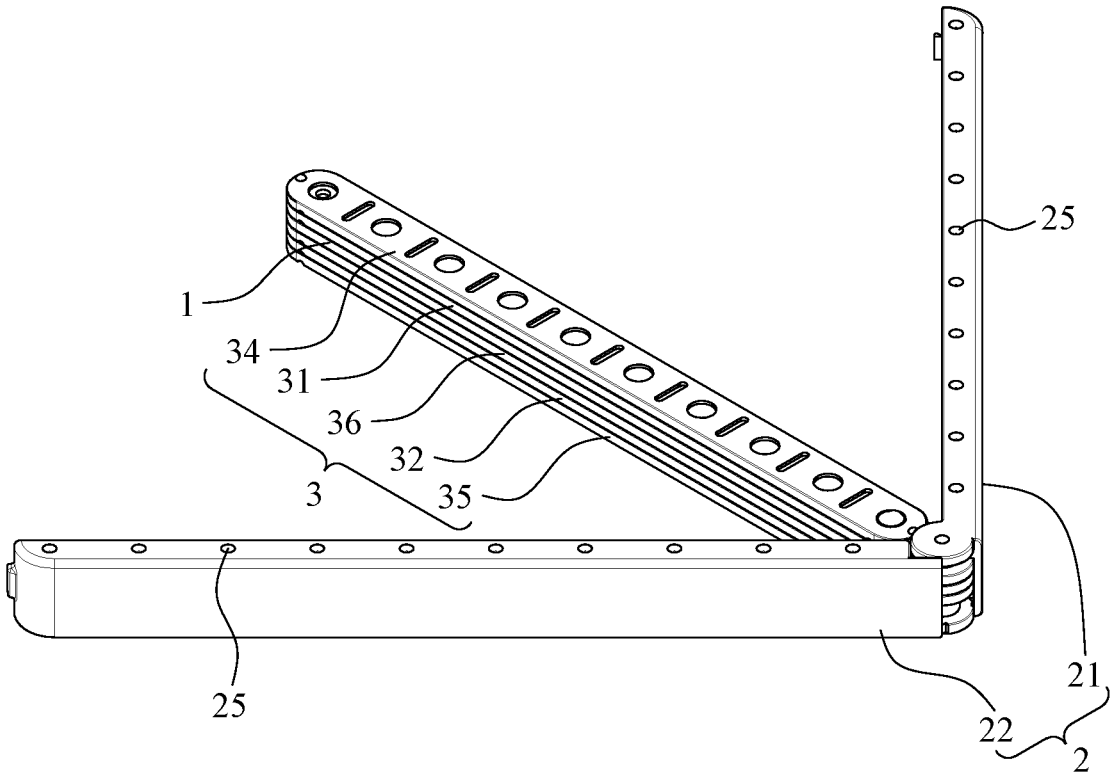
FIG. 3 is a schematic view of the preparatory state before the swing aid of the present invention is folded.
Figure 4:
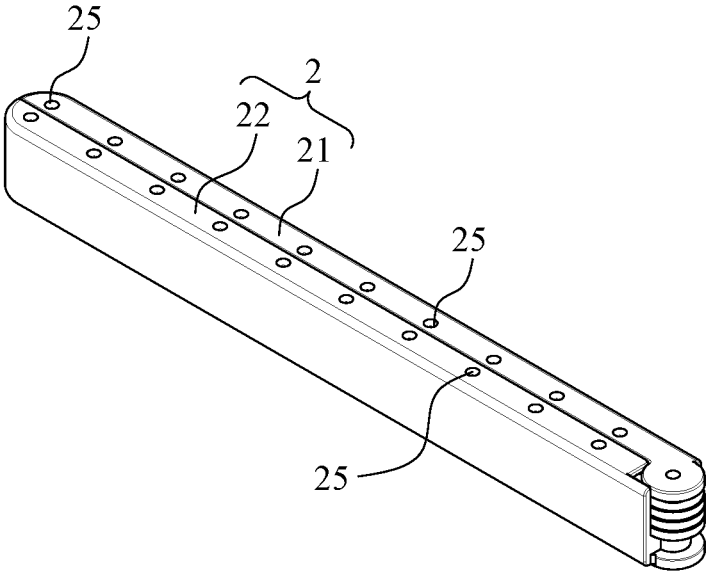
FIG. 4 is a schematic view of the swing aid of the present invention after folding.

The first assembly 2 can be used for marking and storage purposes. The first shell 21 and the second shell 22 are elongated half-shells with matching shapes, so the first shell 21 forms a first space 23, and the second shell 22 forms a second space 24. Both the first shell 21 and the second shell 22 have one end pivotally connected to the first end 11. After the two shells are assembled, as shown in FIGS. 3 and 4, the second assembly 3 can accommodate the first assembly 2 and the support member 1 to be stored herein, so as to save the volume and facilitate storage. In addition, the surfaces of the first shell 21 and the second shell 22 have a plurality of distance gauge symbols 25 disposed at equal intervals. In the present embodiment, the distance gauge symbols 25 are concave circular grooves, but not limited to thereto. In addition, the distance between two adjacent distance gauge symbols 25 may be 1 cm, 2 cm, or 1 inch. As shown in FIG. 1, the first shell 21 and the second shell 22 can be adjusted to become a straight line, and the distance gauge symbols 25 at different positions are used as reference points for the golf ball to be placed. As shown in FIG. 2, the first shell 21 and the second shell 22 can also be adjusted to be arrow-shaped used as a reference stance position for the putter practitioner.

The second assembly 3 is mainly used for marking. The first indicator 31 and the second indicator 32 are both plate-shaped, and both have one end pivotally connected to the second end 12. The first indicator 31 and the second indicator 32 are pivotally connected to the upper and lower sides of the supporting member 1 respectively, and can be stacked as a whole after being folded. As shown in FIG. 3, the supporting member 1 is located between the first indicator 31 and the second indicator 32. In addition, the surfaces of the first indicator 31 and the second indicator 33 have a plurality of distance gauge symbols 33 disposed at equal intervals. In the present embodiment, the distance gauge symbol 33 is a long groove, but it is not limited to herein.

Moreover, in order to facilitate increasing the length and other purposes, the second assembly 3 includes a first extension member 34, a second extension member 35 and a third indicator 36. The first extension member 34 is in the shape of a plate, and is pivotally connected to the end of the first indicator 31 away from the pivotal connection with the support member 1. After adjustment, the first indicator 31 and the first extension member 34 form a longer straight line. In addition, after adjustment, the first extension member 34, the first indicator 31, and the support member 1 can also be stacked, and the first indicator 31 is located in the middle layer.

The second extension member 35 is in the shape of a plate and is pivotally connected to the end of the second indicator 32 away from the second end 12. After adjustment, the second indicator 32 and the second extension member 35 form a longer straight line. In addition, after adjustment, the second extension member 35, the second indicator 32 and the support member 1 can also be stacked, and the second indicator 32 is located in the middle layer.

The third indicator 36 is in the shape of a plate, with one end pivotally connected to the second end 12 of the support member 1. The third indicator 36 can also adjust the included angle between the third indicator 36 and the support member 1. As shown in FIG. 1, the support member 1, the first indicator 31, the second indicator 32, and the third indicator 36 form a cross-shape after adjustment, which can be used for reference of the stance position. In addition, the surfaces of the first extension member 34, the second extension member 35, and the third indicator 36 also have a plurality of distance gauge symbols 33 disposed at equal intervals.

Figure 5:
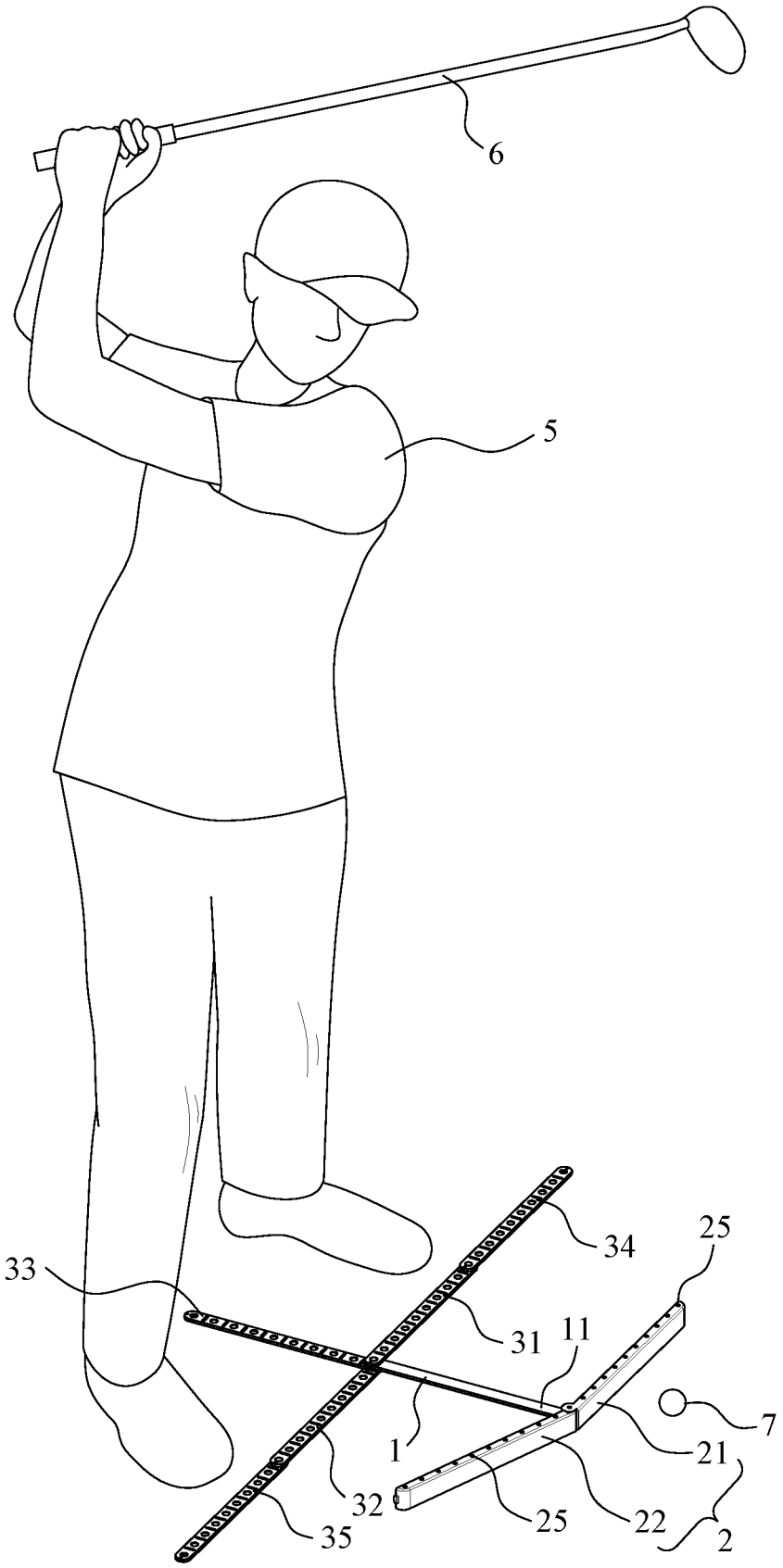
FIG. 5 is a first use embodiment view for the swing aid of the present invention.

Next, a description will be given on the usage of the swing aid of the present invention. FIG. 5 shows the reference method of the stance, the stance width, and the ball position when a practitioner 5 uses a wood club. At this point, the support member 1, the first indicator 31, the second indicator 32, and the third indicator 33 are adjusted to be cross-shaped, the first shell 21 is perpendicular to the support member 1, and the included angle between the second shell 22 and the support member 1 is an acute included angle. When using the wood club 6, the distance between the feet is slightly larger than the shoulder width, and the third indicator 36 can be used between the feet to ensure the middle position. Both feet can stand near the first indicator 31 and the second indicator 32, and use a plurality of the distance gauge symbols 33 to confirm the stance width. "Ball position" can be determined in reference to the distance gauge symbol 25 at the appropriate position on the first shell 21. Using the wood club 6, the ball position of golf ball 7 is close to the inner side of the left foot, approximately 5 to 7 distance gauge symbols 25 away from the first end 11. The second shell 22 is the path after the downward swing. As such, after each swing, the above process can be used to confirm the stance and ball position, so that the practice effect can be improved.

Figure 6:
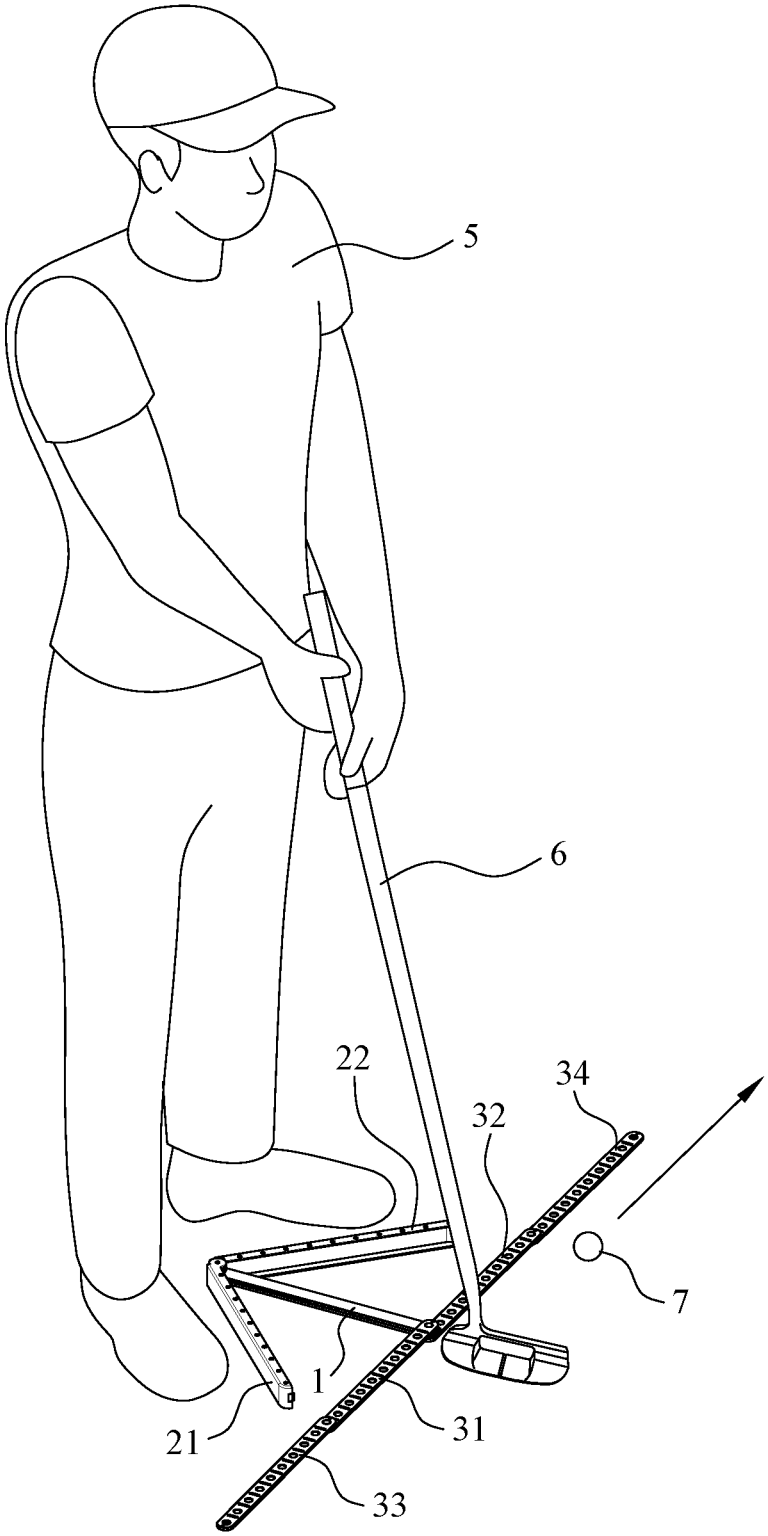
FIG. 6 is a second use embodiment view for the swing aid of the present invention.

FIG. 6 shows a reference method for the stance position when the practitioner 5 uses a putter 7. The first shell 21 and the second shell 22 are adjusted to be arrow-shaped, and the first extension member 34, the first indicator 31, the second indicator 32, and the second extension member 35 are adjusted to form a straight line. The practitioner 5 stands on both feet at the outside of the first shell 21 and the second shell 22, and uses the straight line to guide the swing direction of the putter 7, so that the practitioner 5 can also confirm whether the golf ball 7 moves in a straight line after the hit, and then practice the accuracy of the putter.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A swing aid, comprising:

a support member, having an elongated shape with a first end and a second end;

a first assembly, comprising a first shell and a second shell, the first shell and the second shell being pivotally connected to the first end, the first shell and the second shell being rotatable around the first end to adjust included angles with respect to the support member, respectively; and a second assembly, comprising a first indicator and a second indicator, and the first indicator and the second indicator being pivotally connected to the second end, the first indicator and the second indicator being rotatable around the second end to adjust included angles with respect to the support member, respectively;

wherein the support member, the first indicator and the second indicator are all plate-shaped, and the first indicator and the second indicator are pivotally connected to upper and lower opposite sides of the support member respectively, and are foldable into a stacked shape; and the support member is located between the first indicator and the second indicator.

2. The swing aid according to claim 1, wherein surfaces of the first shell, the second shell, the first indicator and the second indicator are provided with a plurality of distance gauge symbols at equidistant intervals.

3. The swing aid according to claim 1, wherein the second assembly further comprises a third indicator, the third indicator is plate-shaped and pivoted to the second end, and the third indicator can be adjusted to adjust an included angle with respect to the support member.

4. The swing aid according to claim 3, wherein a surface of the third indicator is equidistantly disposed with a plurality of distance gauge symbols.

5. The swing aid according to claim 1, wherein the first shell and the second shell are half shells with matching shapes, the first shell has a first space, and the second shell has a second space; after the first shell and the second shell are combined, the first indicator, the support member and the second indicator are accommodated in the first space and the second space.

6. A swing aid, comprising:

a support member, having an elongated shape with a first end and a second end;

a first assembly, comprising a first shell and a second shell, the first shell and the second shell being pivotally connected to the first end, the first shell and the second shell being rotatable around the first end to adjust included angles with respect to the support member, respectively; and a second assembly, comprising a first indicator and a second indicator, and the first indicator and the second indicator being pivotally connected to the second end, the first indicator and the second indicator being rotatable around the second end to adjust included angles with respect to the support member, respectively;

wherein the second assembly further comprises a first extension member, the first extension member is pivotally connected to one end of the first indicator away from the pivotal connection between the first indicator and the support member, the first extension member is in a shape of a plate, the first extension member, the first indicator, and the support member are in a stacked shape after being folded, and the first indicator is located in a middle layer.

7. The swing aid according to claim 6, wherein a surface of the first extension member is equidistantly disposed with a plurality of distance gauge symbols.

8. A swing aid, comprising:

a support member, having an elongated shape with a first end and a second end;

a first assembly, comprising a first shell and a second shell, the first shell and the second shell being pivotally connected to the first end, the first shell and the second shell being rotatable around the first end to adjust included angles with respect to the support member, respectively; and a second assembly, comprising a first indicator and a second indicator, and the first indicator and the second indicator being pivotally connected to the second end, the first indicator and the second indicator being rotatable around the second end to adjust included angles with respect to the support member, respectively;

wherein the second assembly further comprises a second extension member, the second extension member is pivotally connected to one end of the second indicator away from the pivotal connection between the second indicator and the support member, the second extension member is in a shape of a plate, the second extension member, the second indicator, and the support member are in a stacked shape after being folded, and the second indicator is located in a middle layer.

9. The swing aid according to claim 8, wherein a surface of the second extension member is equidistantly disposed with a plurality of distance gauge symbols.

* * * * *